US006644233B2

(12) United States Patent
Batt et al.

(10) Patent No.: US 6,644,233 B2
(45) Date of Patent: Nov. 11, 2003

(54) ADJUSTABLE THIGH BRACE

(75) Inventors: Gregory S. Batt, Central, SC (US); Forrest Callaway, Easley, SC (US); David Maughan, Easley, SC (US)

(73) Assignee: Perception, Inc., Easley, SC (US)

( * ) Notice: Subject to any disclaimer, the term of this patent is extended or adjusted under 35 U.S.C. 154(b) by 55 days.

(21) Appl. No.: 10/033,295

(22) Filed: Dec. 28, 2001

(65) Prior Publication Data

US 2002/0053312 A1 May 9, 2002

Related U.S. Application Data

(63) Continuation of application No. 09/705,120, filed on Nov. 2, 2000, now abandoned.

(51) Int. Cl.[7] ..... B63B 35/00
(52) U.S. Cl. ..... 114/347; 114/363
(58) Field of Search ..... 114/343, 347, 114/362, 363; 441/65

(56) References Cited

U.S. PATENT DOCUMENTS 5,417,179 A * 5/1995 Niemier et al. ..... 114/347
5,970,903 A * 10/1999 McDonough et al. ..... 114/347
6,105,531 A * 8/2000 Knight ..... 114/347

FOREIGN PATENT DOCUMENTS

FR 2673416 * 9/1992 ..... 114/347

* cited by examiner

*Primary Examiner*—Stephen Avila
(74) *Attorney, Agent, or Firm*—McNair Law Firm, P.A.; Cort Flint

(57) ABSTRACT

A kayak is disclosed having improved control and bracing for acommodating a kayaker wherein a cockpit rim encircles the cockpit seat and adjustable thigh braces are provided in the seat. The adjustable thigh braces include a right thigh brace carried in said cockpit for receiving the right thigh of the kayaker and having contoured outer and inner thigh braces for bracing respective outer and inner thigh portions of the kayaker's right thigh when in the seated position. A left thigh brace is carried in the cockpit for receiving the left thigh of the kayaker having contoured outer and inner thigh braces for bracing respective outer and inner thigh portions of the kayaker's left thigh when in the seated position.

Adjustable mounting assemblies interconnect the right and left thigh braces and the kayak which are constructed and arranged so that the right and left thigh braces may be adjusted longitudinally and rotationally with respect to the kayaker's thighs to accommodate the kayaker's thigh length and girth so that increased control over the kayak is had through the body movements of the kayaker.

29 Claims, 5 Drawing Sheets

ADJUSTABLE THIGH BRACE

This application is a continuation of U.S. application Ser. No. 09/705,120, filed on Nov. 2, 2000, now abandoned.

BACKGROUND OF THE INVENTION

The invention relates to the field of kayaks, and more particularly to an adjustable thigh brace which provides adjustability and improved bracing for the inner and outer thighs of a kayaker and improved control over the kayak, particularly in white water conditions.

In kayaking, particularly white water kayaking, it is important for the kayaker to have as much control as possible over the kayak. For that reason, thigh braces have been provided which allow the kayaker to brace himself in the cockpit, and exercise control over the kayak. Previously, thigh braces have been provided in kayaks which have basically included a fixed mount thigh brace which is affixed in the forward part of the cockpit rim. The thigh brace is stationary and has not included any adjustment. Moreover, the thigh brace only includes an inner contact surface for bracing the inner thigh. In addition, it has been known to have an adjustable thigh brace which is adjustable only in a longitudinal direction to adjust to the leg length, which also includes only an inner thigh brace surface contactable only by the inner thigh. U.S. Pat. No. 4,589,365 shows one example of such a longitudinally adjustable thigh brace in an open cockpit type of kayak. While providing some control over the kayak has been provided by the prior art through kayak thigh braces, they have been only partially effective. As the sport of kayaking extends toward the outer limits, the need for more body control over the kayak has arisen. In effect, the kayaker's body and the kayak need to become one.

Accordingly, an object of the invention is to provide kayak thigh braces for more kinesthetic control over the kayak.

Another object of the present invention is to provide opposing thigh braces in a kayak cockpit having an increased thigh bracing surface which allows a kayaker to more integrally wedge himself into the kayak for better control of the kayak.

Another object of the present invention is to provide a thigh brace for the cockpit of a kayak which is more fully adjustable to accommodate the length and girth of a kayaker's thigh to better brace the kayaker so that more control over the kayak may be had.

Another object of the present invention is to provide a thigh brace which has an inner thigh contact surface and an outer thigh contact surface for each thigh so that improved bracing and control of the kayak is had.

SUMMARY OF THE INVENTION

The above objectives are accomplished according to the present invention by providing a kayak having improved control wherein the kayak includes adjustable thigh braces carried in the kayak cockpit for bracing the kayaker in the cockpit, including right and left thigh braces for receiving the right and left thighs of the kayaker in the seated position. The right thigh brace includes an outer thigh brace for bracing the outer right thigh portion and an inner thigh brace for bracing the inner right thigh portion of the kayaker when seated. The left thigh brace includes an outer thigh brace for bracing the outer left thigh portion and an inner thigh brace for bracing the inner left thigh portion of the kayaker when seated. A right adjustable mount interconnects the right thigh brace and the kayak, the adjustable mount being constructed and arranged so that the right thigh brace may be adjusted longitudinally nd laterally with respect to the kayaker's right thigh to accommodate the kayaker's thigh length and girth. A left adjustable mount interconnects the left thigh brace and the kayak, the left adjustable mount being constructed and arranged so that the left thigh brace may be adjusted longitudinally and laterally to accommodate the kayaker's thigh length and girth whereby increased control over the kayak is had through the body movements of the kayaker. The adjustable mounts preferably include a plurality of first indexed adjustment elements carried by the thigh braces.

A plurality of second indexed adjustment elements are carried by the kayak. The second indexed elements may be aligned in selective correspondence with the first indexed adjustment elements of the mounting block or slot to provide connection of the thigh braces in one of a plurality of combinations of longitudinal and lateral positions for adjusting the thigh brace to accommodate the length and girth of the kayaker's thighs. Advantageously, the first indexed adjustment elements include laterally spaced elements, and the second indexed adjustment elements include longitudinally spaced elements. The adjustment elements may comprise holes, and include a connector received through the holes for locking the thigh braces in a selected thigh brace position. The right and left thigh braces include an interior contoured surface which defines the outer thigh brace and the inner thigh brace of the right and left thigh braces. The interior contoured surfaces of the right and left thigh braces are mirror images of each other. The interior contoured surfaces of the right and left thigh braces are tapered inwardly around the leg in the direction of the bow of the kayak for adapting to the shape of the kayaker's thigh. The first and second adjustable mounts may include an elongated slot formed in upper portions of the right and left thigh braces and a pivot connector extended through the slot interconnects the thigh braces to the kayak. The pivot connector along with the indexed element connector secure the thigh braces in position after allowing adjustment of the thigh braces.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
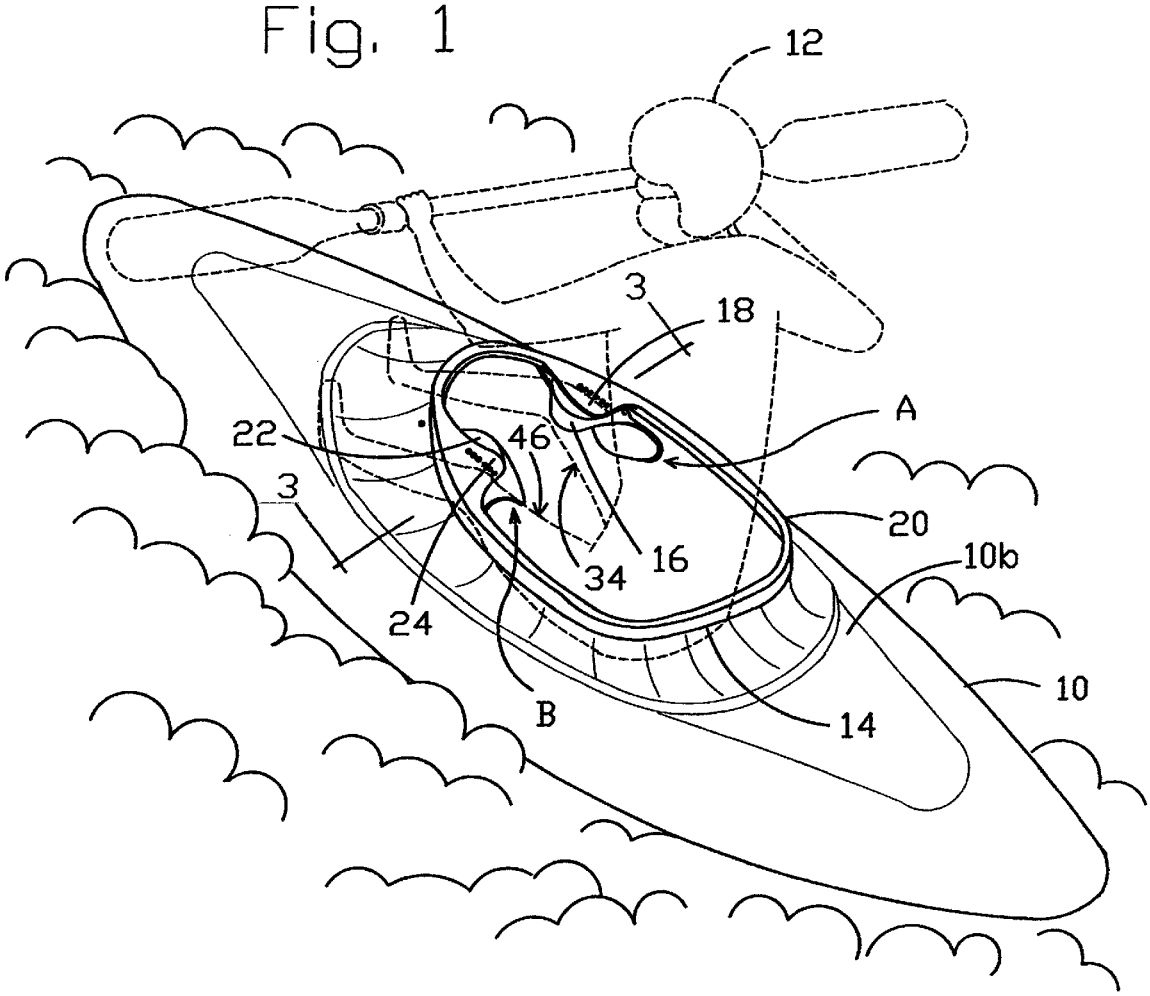
FIG. 1 is a perspective view illustrating a kayaker seated within a kayak and braced therein by means of adjustable thigh braces for kinesthetic control over the kayak in accordance with the invention.
Figure 3:
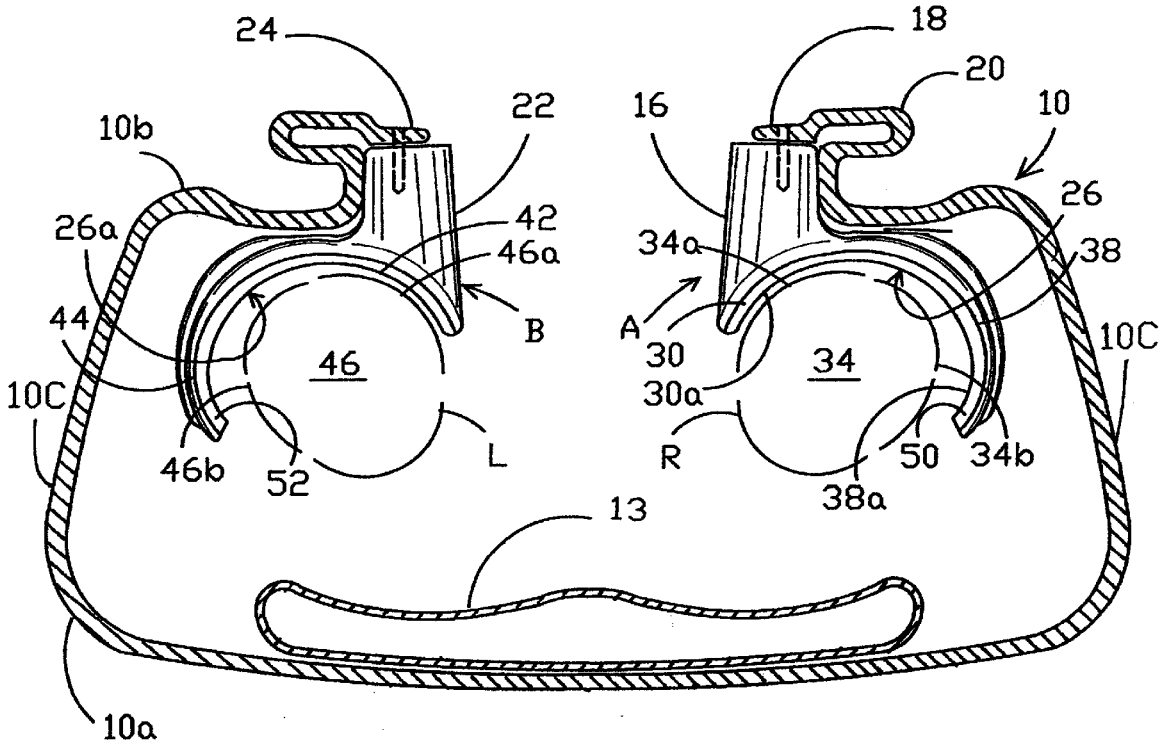
FIG. 3 is a sectional view taken along line 3—3 of FIG. 1.

As can best be seen in FIGS. 1 and 3, a kayak 10 is illustrated having adjustable thigh braces, designated generally as A and B, for bracing a kayaker 12 in a seated position on a seat 13 within a kayak cockpit 14. The kayak typically includes a hull 10*a* with an upper deck 10*b* and a pair of side walls 10*c* in which the cockpit opening is formed. Adjustable thigh braces A, and B, provide adjustment in two directions, e.g. longitudinal and laterally with respect to a centerline of the hull and the right and left thighs 12*a,* 12*b,* of the boater. Right adjustable thigh brace A includes a mounting block 16 which attaches to a winged mounting tab 18 integrally formed with a cockpit rim 20 which is formed around the parameter of the cockpit opening. Likewise, left adjustable thigh brace B includes a mounting block 22 which mounts to a winged mounting tab 24 integrally formed at the left side of the cockpit rim 20.

Figure 2:
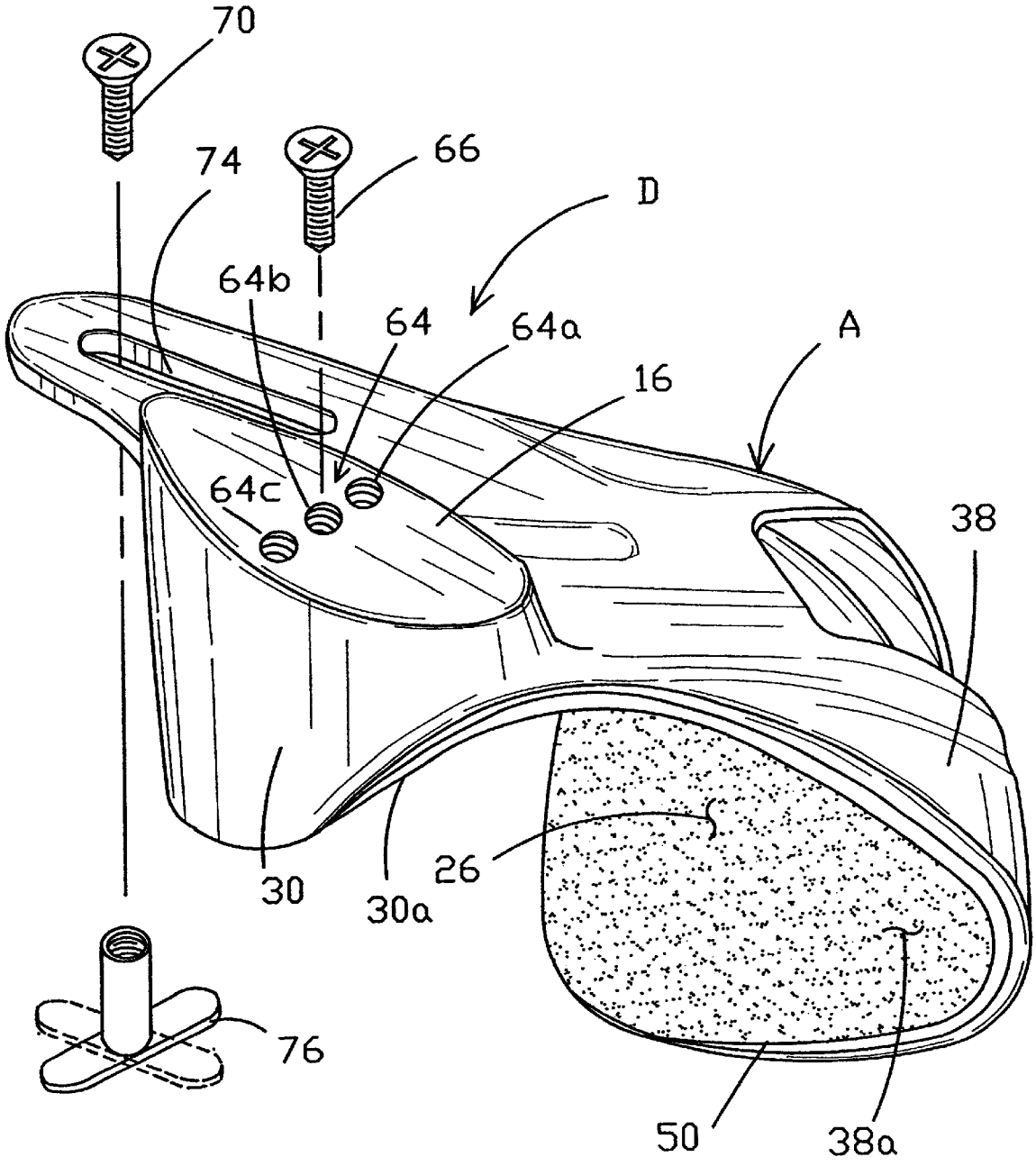
FIG. 2 is a perspective view of an adjustable right thigh brace according to the invention it being understood that the left thigh brace is a mirror image of the right thigh brace.

As cab best be seen in FIGS. 2 and 3, mounting block 16 extends downwardly and terminates at a junction with an interior contoured surface, designated generally as 26, having an inner thigh brace 30 which is contoured at 30*a* to fit against a right inner thigh portion 34*a* of right leg 34 of the boater. The inner thigh brace extends over continuous interior contoured surface 26 to form an outer thigh brace 38 for engaging an outer thigh portion 34*b* of right leg 34, the approximate dimensions being for illustrative purposes only. Left thigh brace B includes an interior contoured surface, designated generally as 26*a,* that is a mirror image of contoured surface 26. Accordingly, mounting block 22 extends downwardly to a junction with surface 26*a* where surface 26*a* includes a left inner thigh brace 42 and a left outer thigh brace 42 for bracing respective inner and outer thigh portions 46*a,* 46*b* of the kayaker's left thigh 46. There are cushioned pads 50, 52 covering the contoured surfaces of thigh braces A, B.

Figure 3A:
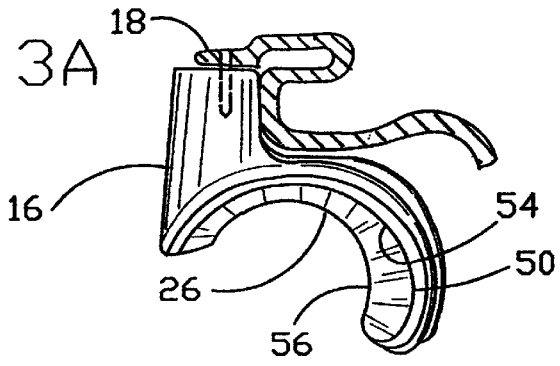
FIG. 3A is an enlarged view of an adjustable right thigh brace according to the invention illustrating the interior contoured surface which tapers inwardly around the leg along the thigh to accommodate the shape of the thigh it being understood that the left thigh brace has an interior contoured surface which is a mirror image of the interior surface of the right thigh brace.
Figure 4:
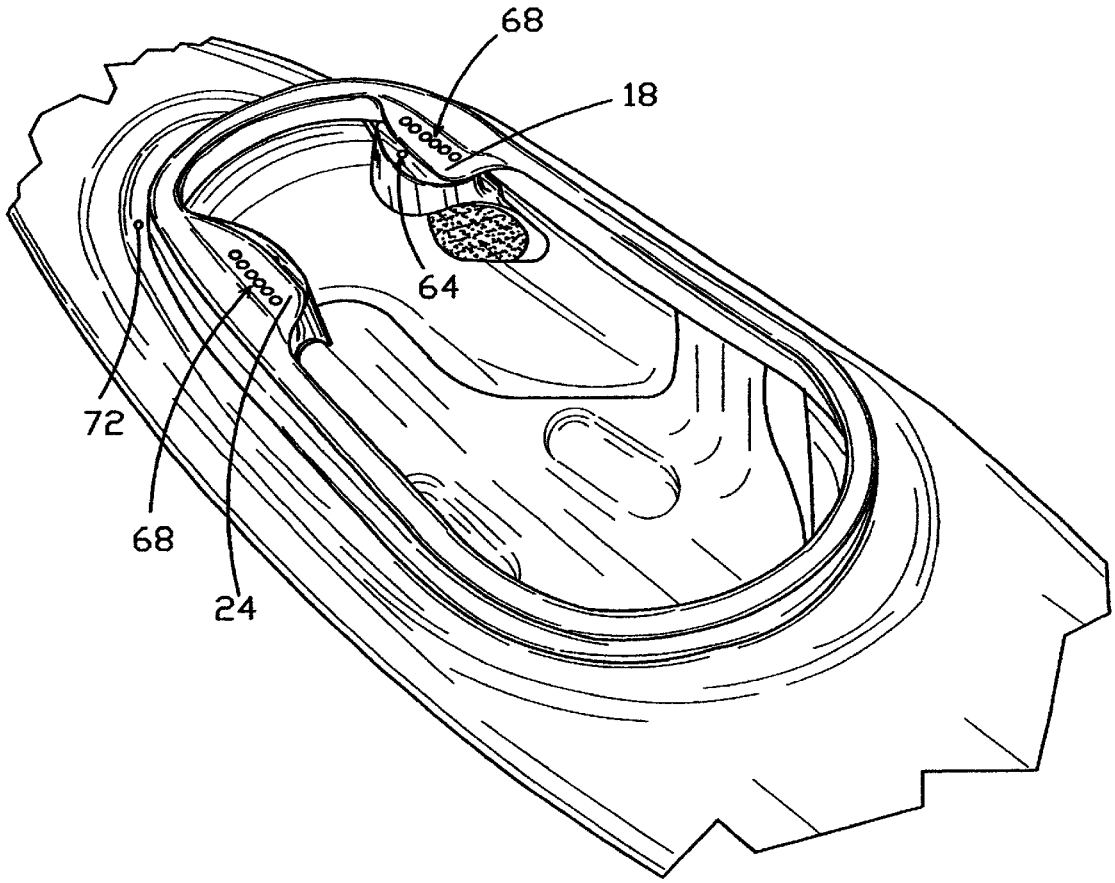
FIG. 4 is an enlarged perspective view of a kayak cockpit having adjustable thigh braces according to the invention.

As can best be seen in FIG. 3A, the thigh brace surfaces 26, 26*a* (mirror image) taper inwardly around the thigh toward the knee to fit the contour of the thighs. The interior contoured thigh brace surfaces also taper inwardly around the thigh from 54 to 56 to fit the contour of the thigh as the leg gets smaller from the hip to the knee. There is a cutout 58 formed in the back of the outer thigh brace for receiving a foam insert (not shown) that can be sanded or otherwise shaped to bear against the side of the kayak when the thigh brace has been adjusted as desired to provide extra support and a tight fit.

Figure 5:
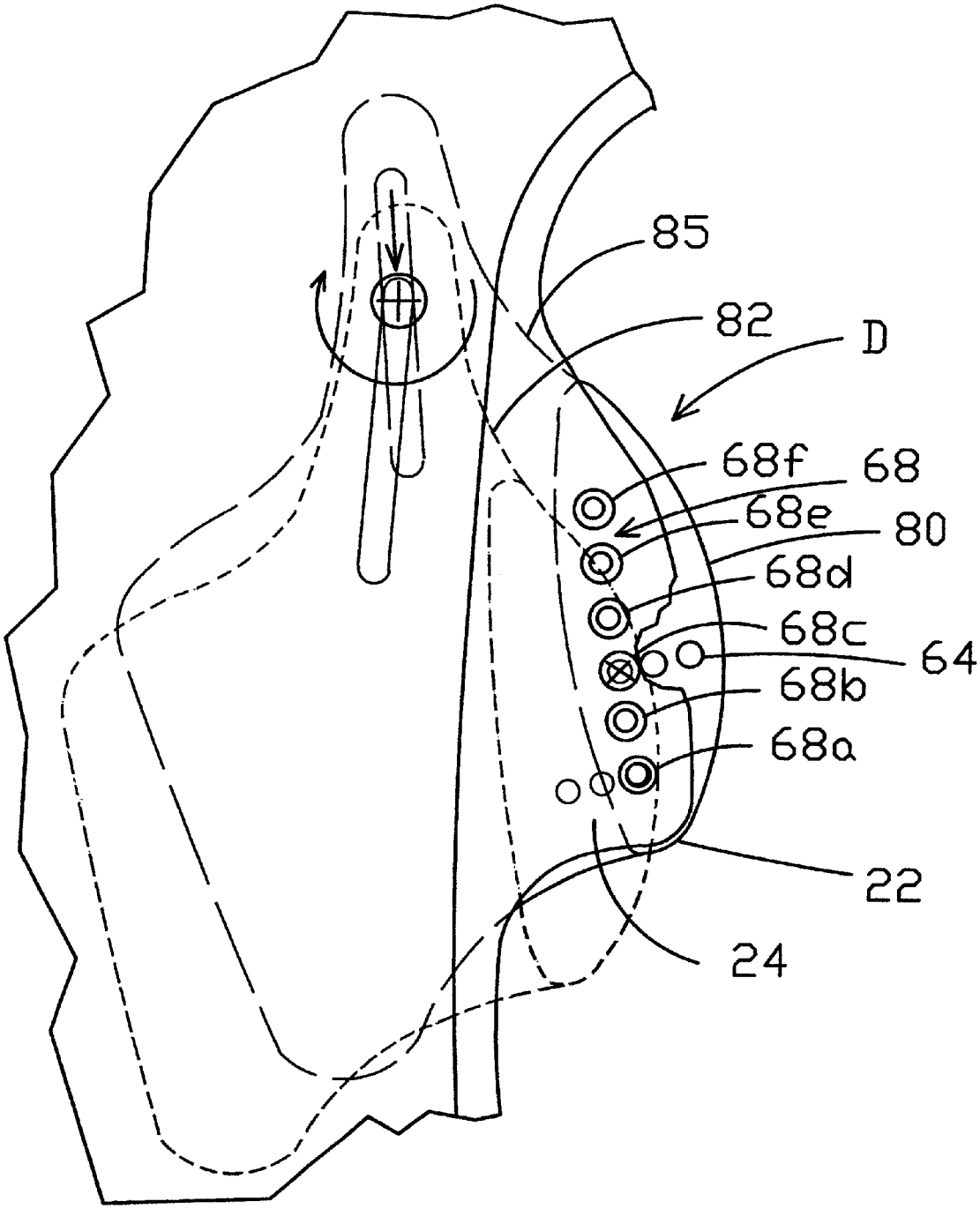
FIG. 5 is a top plan view illustrating a plurality of adjustable positions in a longitudinal and latitudinal direction of adjustable thigh braces according to the invention.

As can best be seen in FIGS. 2 and 5, an adjustable mount assembly, designated generally as D, is provided for adjustably mounting the left and right thigh braces to the kayak cockpit. Adjustable mounting assembly D is the same for the left and right thigh braces, except for the reversibility of some parts. Accordingly, only the adjustable mount assembly will be described interchangeably in FIGS. 2 and 5, between the right and left thigh brace, it being understood, of course, that the same would be true for the other thigh brace. Adjustable mount assembly D includes mounting block 16 (22 for left thigh brace) having a plurality of indexed adjustment elements in the form of threaded openings 64*a* through 64*b,* or a slot for receiving a threaded fastener 66. The indexed attachment element 64 provide adjustment in the lateral direction relative to the kayaker's thigh. Mounting assembly D further provides a second adjustable indexed elements 68 in the form of holes 68*a* through 68*f* formed in winged tabs 24 and 18. The second indexed elements 68 provide for adjustment in a longitudinal direction relative to the thighs of a kayaker seated in the cockpit. Hole 68 receives fastener 66 for insertion into one of the adjusting elements 64 when the fully adjusted position is reached. For structural integrity, a second fastener 70 is received through an opening 72 formed in upper deck 10*b* of the kayak. Fastener 70 then is received in an elongated slot 74 and secured by means of a T nut 76. It will be noted that elongated slot 74 has a length sufficient to accommodate movement of the thigh brace relative to fastener 70 through the full range of longitudinal positions provided by indexed elements 68. In addition, as the thigh braces are adjusted by indexed elements 64, the thigh braces will be allowed to pivot about fastener 70. It is to be understood, of course, that indexed elements 68, 64 may be reversed on the thigh braces and kayak. Also, a single indexed opening in one part may be used with an array of indexed elements on the other part which are spaced to provide longitudinal and lateral adjustment. A slot may be used instead of discrete openings 64 for infinite adjustment.

Thus, a full range of longitudinal and lateral positions for thigh braces A, B is provided depending on which indexing elements 68 and which indexing elements 64 are selected. For example, as can best be seen in FIGS. 2 and 5, there is a full line position 80 (and dash line 85) shown when fastener 66 is received through indexing element 64c and indexing element 68*c.* There is a second adjusted position shown in dotted line 82 when fastener 66 is received through indexed element 64*a* and indexed element 68*a.* In total, it can be seen that there are several different adjusted positions available for the thigh braces. It is to be understood, of course, that the lateral index element 64 may be provided in winged tabs 24, 18, and that the longitudinal index element 68 may be provided in mounting blocks 22, 16, respectively. The longitudinal adjustment of the thigh braces allows for different length thighs. The pivot adjustment of the thigh brace allows to adjust for different girths of the thighs.

Thus, it can be seen that a highly advantageous construction can be had for adjustable thigh braces for kayaks according to the invention wherein the kayaker can be fitted into the kayak cockpit to provide kinesthetic control over the kayak, that is, the movements of the kayaker will be sensed by the kayak so that body control is had over the kayak in addition to paddle control. For example, if the kayaker desires to put the kayak into a right roll, right thigh 34 would be pushed against inner surface 26 of right thigh brace 38 and left thigh 46 would be lifted up against inner surface 26*a* of left thigh brace 42 to further effect the right roll. A right roll is needed in a situation where the kayak has been turned upside down and the kayaker desires to return the kayak to an upright position. Of course, it can be seen that right and left turns as well as other maneuvers known to kayakers could be effected by using various combinations of the right and left inner and outer thigh braces.

While a preferred embodiment of the invention has been described using specific terms, such description is for illustrative purposes only, and it is to be understood that changes and variations may be made without departing from the spirit or scope of the following claims.

What is claimed is:

1. A kayak having improved control, said kayak having an upper deck, a cockpit for accommodating a kayaker in a seated position and a cockpit rim defining a cockpit opening for receiving the kayaker, said kayak comprising:

adjustable thigh braces carried in the kayak cockpit for bracing the kayaker within the cockpit including right and left thigh braces for receiving the right and left thighs of the kayaker in the seated position;

said right thigh brace including an outer thigh brace for bracing the outer right thigh portion and an inner thigh brace for bracing the inner right thigh portion of the kayaker when seated in the seated position;

said left thigh brace including an outer thigh brace for bracing the outer left thigh portion and an inner thigh brace for bracing the inner left thigh portion of the kayaker when seated in the seated position;

a right adjustable mount interconnecting said right thigh brace and the kayak, said right adjustable mount being constructed and arranged so that said right outer and inner thigh brace may be adjusted longitudinally and rotationally with respect to the kayaker's right thigh to accommodate the kayaker's thigh length and girth; and a left adjustable mount interconnecting said left thigh brace and the kayak, said left adjustable mount being constructed and arranged so that said left outer and inner thigh brace may be adjusted longitudinally and rotationally to accommodate the kayaker's thigh length and girth;

whereby increased control over the kayak is had through the body movements of the kayaker.

2. The kayak of claim 1 wherein said adjustable mounts include mounting blocks carried by said right and left thigh braces which include a plurality of first indexed adjustment elements for connecting said mounting block to the kayak.

3. The kayak of claim 2 including a right connector tab and a left connector tab being carried by respective right and left portions of said cockpit rim; and said mounting blocks of said right and left thigh braces being connected to respective ones of said right and left connector tabs.

4. The kayak of claim 3 wherein said right and left connector tabs include a plurality of second indexed adjustment elements; and said second indexed elements being in selective correspondence with said first indexed adjustment elements of said mounting block to provide connection of said thigh braces in one of a plurality of combinations of longitudinal and lateral positions for adjusting the thigh brace to accommodate the length and girth of the kayaker's thighs.

5. The kayak of claim 4 wherein said first indexed adjustment elements include laterally spaced elements, and said second indexed adjustment elements include longitudinally spaced elements.

6. The kayak of claim 5 wherein said adjustment elements comprise holes, and including a connector received through said holes for locking said thigh braces in a selected thigh brace position.

7. The kayak of claim 1 wherein said right thigh brace includes an interior contoured surface which defines said outer thigh brace and said inner thigh brace of said right thigh brace;

said left thigh brace includes an interior contoured surface which defines said outer thigh brace and inner thigh brace of said left thigh brace; and, said interior contoured surfaces of said right and left thigh braces being mirror images of each other.

8. The kayak of claim 7 wherein said interior contoured surfaces of said right and left thigh braces are tapered inwardly around the thigh toward a bow of the kayak for adapting to the shape of the kayaker's thigh.

9. The kayak of claim 8 wherein said inner and outer thigh braces include cushioned pads carried by said interior contoured surfaces.

10. The kayak of claim 1 wherein said first and second adjustable mounts include an elongated slot formed in upper portions of said right and left thigh braces;

a pivot connector extended through said slot interconnecting said thigh braces to said kayak;

a plurality of first indexed adjustment elements carried by one of said kayak and thigh braces; and, at least one corresponding second indexed adjustment element carried by the other of said kayak and thigh braces so that one of said plurality of indexed elements may be corresponded with said at least one second indexed adjustment element to provide longitudinal and lateral adjustment of the relative position of said right and left thigh braces to accommodate the length and girth of the kayaker's right and left thighs.

11. The kayak of claim 10 wherein said first indexed elements are carried by said thigh braces and include indexed elements generally laterally spaced, and including a plurality of said second indexed adjustment elements generally longitudinally spaced.

12. The kayak of claim 1 wherein said first and second adjustable mounts include a plurality of longitudinally and laterally indexed adjustment elements, and a connector interconnecting said kayak and said thigh braces by means of selected ones of said indexed elements to provide a desired thigh brace position.

13. For use in a kayak having a hull with a pair of side walls an upper deck, a cockpit formed in the upper deck of the kayak hull which includes a cockpit seat for accommodating a kayaker, and a cockpit rim encircling the cockpit seat, adjustable thigh braces comprising:

a right thigh brace carried in said cockpit and spaced from said side walls for receiving the right thigh of the kayaker when seated; said right thigh brace including an outer thigh brace for bracing an outer thigh portion and an inner thigh brace for bracing an inner thigh portion of the kayaker when in the seated position;

a left thigh brace carried in the cockpit and spaced from said side walls for receiving the left thigh of the kayaker when seated; said left thigh brace including an outer thigh brace for bracing an outer left thigh portion and an inner thigh brace for bracing an inner left thigh portion of the kayaker when in the seated position;

a right adjustable mount for interconnecting said right thigh brace and the kayak, said right adjustable mount being constructed and arranged so that said right thigh brace may be adjusted longitudinally and laterally with respect to the kayaker's thighs to adjust to the thigh length and girth of the kayaker; and a left adjustable mount for interconnecting said left thigh brace and the kayak, said left adjustable mount being constructed and arranged so that said left thigh brace may be adjusted longitudinally and a laterally to adust to the thigh length and girth of the kayaker;

whereby increased control over the kayak is had through the body movements of the kayaker.

14. The kayak of claim 13 wherein said adjustable mounts include mounting blocks carried by said right and left thigh braces which include a plurality of first indexed adjustment elements for connecting said mounting block to the kayak.

15. The kayak of claim 14 wherein said first indexed adjustment elements include laterally spaced elements.

16. The kayak of claim 15 wherein said adjustment elements comprise holes for receiving a connector secured to the kayak hull to lock said thigh braces in a selected thigh brace position.

17. The kayak of claim 13 wherein said right thigh brace includes an interior contoured surface which defines said outer thigh brace and said inner thigh brace of said right thigh brace;

said left thigh brace includes an interior contoured surface which defines said outer thigh brace and inner thigh brace of said left thigh brace; and, said interior contoured surfaces of said right and left thigh braces being mirror images of each other.

18. The kayak of claim 17 wherein said interior contoured surfaces of said right and left thigh braces are tapered inwardly around the thigh toward a bow of the kayak for adapting to the shape of the kayaker's thigh.

19. The kayak of claim 13 wherein said first and second adjustable mounts include an elongated slot formed in upper portions of said right and left thigh braces for receiving a first pivot connector extended through said slot which connects said thigh braces to said kayak; and a plurality of first indexed adjustment elements carried by one of said thigh braces; for being selectively engaged by a second connector secured to the kayak to provide longitudinal and lateral adjustment of the relative position of said right and left thigh braces to accommodate the length and girth of the kayaker's right and left thighs.

20. A kayak having a hull with a bow, stern, a pair of side walls and an upper deck, a cockpit formed in the upper deck of the kayak hull which includes a cockpit for accommodating a kayaker, and a cockpit rim encircling the cockpit, wherein said kayak includes adjustable thigh braces comprising:

a unitary right thigh brace carried in said cockpit and spaced from said side walls for receiving the right thigh of the kayaker having contoured outer and inner thigh braces for bracing respective outer and inner thigh portions of the kayaker's right thigh when seated in the seated position; and a unitary left thigh brace carried in the cockpit and spaced from said side walls for receiving the left thigh of the kayaker having contoured outer and Inner thigh braces for bracing respective outer and inner thigh portions of the kayaker's left thigh when seated in the seated position;

whereby increased control over the kayak is had through the body movements of the kayaker.

21. The kayak of claim 20 including adjustable mounting assemblies interconnecting said right and left thigh braces and the kayak constructed and arranged so that said right and left thigh braces may be adjusted longitudinally and laterally with respect to the kayaker's thighs to accommodate the kayaker's thigh length and girth.

22. The kayak of claim 21 wherein said adjustable mount assemblies include a plurality of first indexed adjustment elements carried by said thigh braces.

23. The kayak of claim 22 including a right connector and a left connector being carried by respective right and left portions of said cockpit rim for selective connection to said first indexed adjusting elements of said right and left thigh braces.

24. The kayak of claim 23 wherein said right and left connectors include a plurality of second indexed adjustment elements; and said second indexed elements may be selectively corresponded with said first indexed adjustment elements of said thigh braces to provide connection of said thigh braces in one of a plurality of combinations of longitudinal and lateral positions for adjusting the thigh braces to accommodate the length and girth of the kayaker's thighs.

25. The kayak of claim 24 wherein said first indexed adjustment elements include laterally spaced elements, and said second indexed adjustment elements include longitudinally spaced elements.

26. The kayak of claim 21 wherein said adjustable mounts include an elongated slot formed in upper portions of said right and left thigh braces; and a pivot connector extended through said slot interconnecting said thigh braces to said kayak.

27. The kayak of claim 21 wherein said right thigh brace includes an interior contoured surface which defines said outer thigh brace and said inner thigh brace of said right thigh brace;

said left thigh brace includes an interior contoured surface which defines said outer thigh brace and inner thigh brace of said left thigh brace; and, said interior contoured surfaces of said right and left thigh braces being mirror images of each other.

28. The kayak of claim 27 wherein said interior contoured surfaces of said right and left thigh braces are tapered inwardly around the thigh toward a bow of the kayak for adapting to the shape of the kayaker's thigh.

29. The kayak of claim 21 wherein said first and second adjustable mounts include a plurality of longitudinally and laterally indexed adjustment elements, and a connector interconnecting said kayak and said thigh braces by means of selected ones of said indexed elements to provide a desired thigh brace position.

* * * * *